US008334643B2

(12) United States Patent
Giordano et al.

(10) Patent No.: US 8,334,643 B2
(45) Date of Patent: Dec. 18, 2012

(54) LED LAMP, IN PARTICULAR FOR INTERNAL LIGHTING OF AN ELECTRIC HOUSEHOLD APPLIANCE

(75) Inventors: Sergio Giordano, Caselle Torinese (IT); Domenico Pietrafesa, San Mauro Torinese (IT)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 13/132,577

(22) PCT Filed: Dec. 3, 2009

(86) PCT No.: PCT/US2009/066527

§ 371 (c)(1),
(2), (4) Date: Jun. 2, 2011

(87) PCT Pub. No.: WO2010/065705

PCT Pub. Date: Jun. 10, 2010

(65) Prior Publication Data

US 2011/0241517 A1 Oct. 6, 2011

(30) Foreign Application Priority Data

Dec. 4, 2008 (IT) ..... TO2008A0900

(51) Int. Cl.
*H01J 1/62* (2006.01)
*H01J 63/04* (2006.01)

(52) U.S. Cl. ..... 313/498; 313/113

(58) Field of Classification Search ..... 313/498, 313/500–502, 512, 113; 362/646, 227, 249.01, 362/249.02, 249.03
See application file for complete search history.

(56) References Cited

U.S. PATENT DOCUMENTS

| | | | |
|---|---|---|---|
| 7,252,402 | B2 | 8/2007 | Gotz et al. |
| 7,300,183 | B2 | 11/2007 | Kiyomoto et al. |
| 2003/0235055 | A1 | 12/2003 | Lodhie |
| 2004/0119603 | A1 | 6/2004 | Bohlander et al. |

(Continued)

FOREIGN PATENT DOCUMENTS

| | | | |
|---|---|---|---|
| DE | 19624087 | A1 | 12/1997 |

(Continued)

OTHER PUBLICATIONS

ISR for PCT/US2009/066527 dated Feb. 5, 2010.

(Continued)

*Primary Examiner* — Anh Mai
*Assistant Examiner* — Kevin Quarterman
(74) *Attorney, Agent, or Firm* — Lowe Hauptman Ham & Berner, LLP

(57) ABSTRACT

A lamp for internal lighting of an electric household appliance includes an LED, a printed circuit for supporting and powering the LED, and a supporting body made of an electrically non-conductive material and provided, at a first end thereof, with a reflecting/diffusing element for light emitted from the LED. The LED is carried on a flat face of the printed circuit, at a first end of the printed circuit. The supporting body has a tubular shape and the printed circuit being supported inside the supporting body, with the flat face arranged substantially coplanar with an optical axis of the reflecting/diffusing element and the first end of the printed circuit overhangingly protruding from the first end of the supporting body, so that the reflecting/diffusing element collects at least a part of the light emitted from the LED. The printed circuit extends over an entire length of the supporting body.

12 Claims, 1 Drawing Sheet

U.S. PATENT DOCUMENTS

| | | | | |
|---|---|---|---|---|
| 2005/0189557 | A1 | 9/2005 | Mazzochette et al. | |
| 2005/0270794 | A1 | 12/2005 | Okamoto et al. | |
| 2007/0195527 | A1 | 8/2007 | Russell | |
| 2007/0297178 | A1* | 12/2007 | Tain et al. | 362/294 |
| 2008/0037239 | A1* | 2/2008 | Thomas et al. | 362/92 |
| 2009/0279292 | A1 | 11/2009 | Vinkenvleugel et al. | |

FOREIGN PATENT DOCUMENTS

| | | | |
|---|---|---|---|
| DE | 10014804 | A1 | 9/2001 |
| DE | 102007006884 | A1 | 8/2008 |
| EP | 1433658 | A2 | 6/2004 |
| WO | 2006104553 | A1 | 10/2006 |

OTHER PUBLICATIONS

Italian Search Report for IT TO2008000900 dated Nov. 4, 2009.

German Office Action for DE 11 2009 004 057 mailed Sep. 21, 2012.

* cited by examiner

LED LAMP, IN PARTICULAR FOR INTERNAL LIGHTING OF AN ELECTRIC HOUSEHOLD APPLIANCE

RELATED APPLICATIONS

The present application is national phase of PCT/US2009/066527 filed Dec. 3, 2009, and claims priority from Italian Application Number TO2008A000900 filed Dec. 4, 2008.

TECHNICAL FIELD

The present invention relates to a LED lamp, particularly designed for internal lighting of electric household appliances.

BACKGROUND ART

It is known that many electric household appliance (such as ovens and refrigerators) use lamps for internal lighting. Nowadays and increasingly in future, these lamps are also intended to equip electric household appliances, such as washing machines and dishwashers, for internally lighting the washing tank.

A cost reduction of LEDs and a parallel increase in emitted light power has nowadays made them a possible alternative light source for these lamps. However, their application for internal lighting of electric household appliance implies the solution of several problems, firstly that of allowing an easy dissipation of the heat generated by the LEDs in use while correctly exploiting all the produced light energy. Compactly structured, easily assembled and relatively low-cost lamps are thus needed.

DISCLOSURE OF INVENTION

It is an object of the present invention to solve the aforesaid problems, by providing a lamp for electric household appliances using a highly compact, reliable, relatively low-cost light source of the LED type which is easy to be assembled and mountable on different types of electric household appliances, from refrigerators to washing machines, while always ensuring an effective disposal of the heat produced by the LED in use.

The present invention thus relates to a LED lamp for an electric household appliance, as defined in claim 1.

In particular, the lamp according to the invention comprises at least a first light source consisting of a LED, a printed circuit for supporting and powering the light source and a supporting body for the printed circuit made of an electrically non-conductive material and provided, at one first end thereof, with a reflecting/diffusing element of the light emitted by the at least one light source and defining an optical axis arranged substantially parallel to a longitudinal symmetry axis of the supporting body; the at least a first light source being firmly carried on a first flat face of the printed circuit and mounted at a first end of the printed circuit, with a light diffusion axis thereof oriented substantially perpendicular to the first face; in combination with these features, the supporting body has a tubular shape and the printed circuit is supported inside the body, with the first face arranged substantially coplanar with the optical axis of the reflecting/diffusing element and the first end overhangingly protruding from the first end of the supporting body, within a concavity of the reflecting/diffusing element, so that the same may collect at least part of the light emitted by the at least one first light source.

According to an important aspect of the invention, the printed circuit extends over the entire length of the supporting body, to a second end thereof which is opposite to the first, and on at least the first face, it is provided with electrically and thermally conductive tracks connected to the at least a first light source, which tracks are exposed in use to a convective cooling motion of the environmental air through respective longitudinal slots made through at least one side wall of the supporting body, at a predetermined distance from the first end and, preferably, towards the second end.

According to a further aspect of the invention, the lamp further comprises a cup-shaped, optical element fitted over the first end of the supporting body so as to accommodate, at a concave bottom wall thereof, the reflecting/diffusing element; at least a first portion of the concave bottom wall, facing the reflecting/diffusing element on the side of the at least a first light source is pervious to light and at least a second portion of the concave bottom wall, opposite to the first, is made as being at least partially reflecting, so as to intercept at least part of the light emitted by the at least one light source to reflect it towards the reflecting/diffusing element.

Thereby, a lamp with a light source consisting of a LED is obtained, which is extremely compact and simple in structure, and relatively cost-effective to be implemented, which does not require wiring for supplying power to the LED light and which is especially able to easily dissipate the heat generated by the LED in use. Furthermore, the main light beam may be emitted towards a prevalent direction and no fraction of the light power emitted by the LED is lost, thus allowing a favorable light/electric consumption ratio. Furthermore, the LED lamp according to the invention may be easy waterproofed simply by filling the first end of the supporting body with a resin in which a portion of the printed circuit close to the first end thereof is embedded. Finally, a two-faced printed circuit may be used by installing a LED on both faces, both at the first end of the printed circuit, and additional electronic components may be mounted to the printed board, such as dusk, temperature or humidity sensors, an NTC for controlling a RGB LED so as to be able to further change the colour of the emitted light, a freshener, etc.

BRIEF DESCRIPTION OF THE DRAWINGS

Further features and advantages of the present invention will be apparent from the following description of a preferred embodiment, exclusively provided by way of non-limitative example, with reference to the accompanying drawings, in which.

BEST MODE FOR CARRYING OUT THE INVENTION

Figure 1:
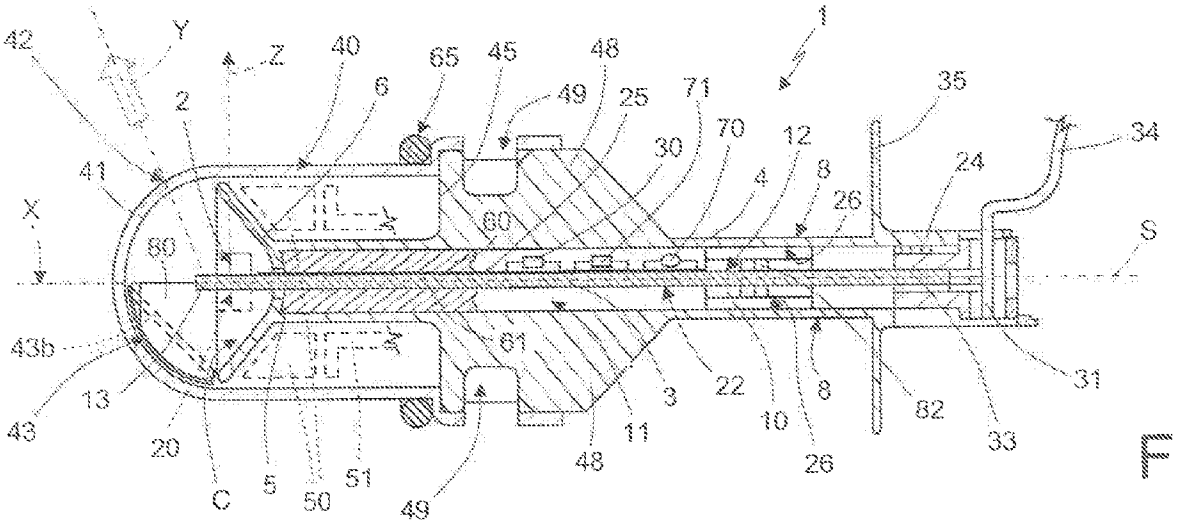
FIG. 1 shows a longitudinal, elevation cross-section view, taken along the axis, of a lamp according to the invention.
Figure 2:
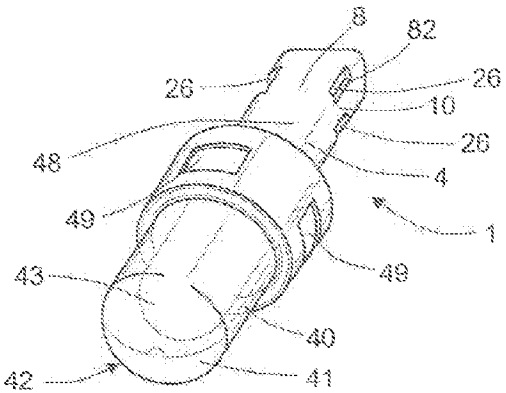
FIG. 2 shows an external, front three-quarter axonometric view of the lamp in FIG. 1.

With reference to FIGS. 1 and 2, numeral 1 indicates as a whole a lamp for internal lighting of an electric household appliance of any known type (not shown), from refrigerators to washing machines.

Lamp 1 comprises at least a first light source 2 consisting of a LED, a printed circuit 3 for supporting and powering the LED 2 and a supporting body 4 for the printed circuit 3 made of an electrically non conducting material, preferably by molding a synthetic plastic material.

At a first end 5, body 4 is provided with a reflecting/diffusing element 6 of the light emitted by LED 2 and defining an optical axis X (e.g. if the element 6 has a parabolic, hyperbolic or parabolic-hyperbolic shape, defined by the geometric axis of the parabola or hyperbola formed thereby) arranged substantially parallel to—and in this case, coinciding with—a longitudinal symmetry axis S of the supporting body 4.

The latter has a tubular conformation and a generally prismatic (parallelepiped) shape being delimited by pairs of flat side walls 8 and 10 arranged perpendicular to each other and delimiting therebetween a longitudinal seat 11 coaxial to the axes X and S within the body 4.

LED 2 is fixedly carried on a first flat face 12 of the printed circuit 3, and is mounted at a first end 13 of the printed circuit 3, with a light diffusing axis Z thereof oriented substantially perpendicular to the face 12; according to an aspect of the invention, in combination with these structural features, the printed circuit 3 is supported within the body 4, in the seat 11, with the laying plane thereof parallel to faces 8 and to axes X and S, and in particular with the face 12 parallel to faces 8 and arranged substantially coplanar with the optical axis X of the reflecting/diffusing element 6.

The printed circuit 3 (hereinafter also indicated as PCB) then has its first end 13 overhangingly protruding from the first end 5 of the supporting body 4, within a concavity C of the reflecting/diffusing element 6, so that the same may collect at least part of the light emitted by LED 2.

By virtue of such an arrangement, according to a possible variant of lamp 1, it may also be provided with more than one light source, in particular with a second LED 20, shown in dashed line in FIG. 1, supported at the first end 13 of the printed circuit 3, on a second face 22 thereof, parallel and opposite to face 12; LED 20 also has the light diffusing axis coinciding with axis Y and thus perpendicular to the printed circuit, and is mounted to be arranged within the concavity C of the reflecting/diffusing element 6, so that it may also collect at least part of the light emitted by LED 20, in addition to that emitted by LED 2.

According to an important aspect of the invention, the printed circuit 3, shaped and placed as described with respect to the body 4, extends over the entire length of the supporting body 4, to a second end 24 thereof, opposite to end 5. Furthermore, on at least face 12 and on both faces 12 and 22 if a second LED 20 is present, the printed circuit 3 is provided with electrically and thermally conductive tracks 25, obtained in one piece by means of known techniques on PCB 3, connected to LED 2 (and to LED 20 if present).

According to the invention, tracks 25 are exposed in use to a convective cooling motion of the environmental air, due to the body 4 being provided with respective longitudinal slots 26 made through at least one side wall 8,10 (in this case through all the walls 8,10, at the longitudinal edges joining the same), at a predetermined distance from end 5 and, preferably, towards the end 24, so as to be spaced in use from the point of using the LED(s) 2/20; in this case, the environmental air present about the body 4, and particularly close to the rear end 24, may enter into the seat 11 to lap on the tracks 25; as being conductive, the latter conduct the heat generated in use by LED 2 (and 20) along the same towards the end 24, whereby the environmental air may remove this heat by lapping on the tracks 25, thus generating a convective motion through the slots 26, which cools the whole printed circuit 3.

For this purpose, the slots 26 are made both above and below the optical axis X and parallelly thereto, so that some of them face the first face 12 of the printed circuit 3 and others face the second face 22 thereof, which is obtained by forming them at the joining edges of the walls 8,10.

Specifically, if only one LED is present (typically LED 2), this may be an RGB-type LED, so as to be able to emit light having a different spectrum; in this case, the printed circuit 3 also carries electronic means 30 (typically an NTC) on-board for controlling the RGB LED 2, connectable in use to the control unit of the electric household appliance (not shown). For this purpose, and for supplying the required voltage to the tracks 25 for operating LED 2 (and 20 if present), end 24 of body 4 is provided with a series of standard connectors 31 integrated with a corresponding end 33 of the printed circuit 3 placed at the end 24. In order to protect the connectors 31, which may be connected in use to electric power supply and control wires 34, the end 24 is provided with a screen 35, e.g. circular in shape.

According to a further aspect of the invention, lamp 1 also comprises a cup-shaped, optical element 40 fitted over the end 5 of the supporting body 4 so as to accommodate the reflecting/diffusing element 6 at a concave bottom wall 41 thereof.

At least a first portion 42 of the concave bottom wall 41, facing the reflecting/diffusing element 6 on the side of LED 2 is pervious to light; while at least a second portion 43 of wall 41, opposite to portion 42, is made (e.g. by inserting a metallized layer or by the provision of appropriate prisms) as being at least partially reflecting, so as to intercept at least part of the light emitted by LED 2 (and by LED 20, if present) to reflect it towards the reflecting/diffusing element 6.

The portions 42 and 43 of the bottom wall 41 are preferably asymmetric and portion 43 is made as a flat surface 43*b* (shown in dashed line in FIG. 1) obliquely arranged with respect to the optical axis X, so as to acquire reflecting power (for certain light angles) even if it is pervious to light.

Therefore, the reflecting/diffusing element 6 is shaped so as to collect the light reflected by the portion 43 of the concave bottom wall 41 of the cup-shaped optical element 40, and at least part of the direct light emitted by LED 2 (and by LED 20, if present), so as not to loose any fraction of the light produced by the LEDs 2,20. Even more preferably, element 6 is shaped to direct both the directed light and the light reflected by portion 43 of the wall 41 towards portion 42 of the wall 41, which portion is pervious to light (transparent), so as to form a prevalent light beam (indicated by the arrow in FIG. 1) having oblique axis Y placed in a solid angle delimited by optical axis X and diffusion axis Z of the light of LED(s) 2/20.

According to another aspect of the invention, in order to reduce production costs, the reflecting/diffusing element 6 is at least partially pervious to light, in the sense that it is not coated on the side of the concavity C, with a reflecting metallized layer totally impervious to light but may be simply made of a synthetic, white plastic material, which is thus naturally reflecting but which lets part of the light rays to escape therethrough; the supporting body 4 is then provided on the side of the second end 24 (but before the slots 26, i.e. closer to the end 5 of the latter) with a reflecting screen 45, e.g. defined by a continuous annular ridge obtained on the walls 8,10 and not necessarily provided with a reflecting layer, but simply made of a white synthetic plastic, for example. And, the optical element 40 extends with a tubular portion 46 thereof pervious to the light and obtained in one piece with the bottom wall 41, to the screen 45, so that the light which escapes back through the element 6 (which for this reason is not simply defined as a reflecting element, but as a reflecting/diffusing element) is collected and reflected by the screen 45 and may be emitted outwards through the optical element 6, thus contributing the main light beam.

Furthermore, at screen 45, the body 4 is also provided with connecting means 48 for the cup-shaped, optical element 6 arranged immediately adjacent to the screen 45 on the side of end 24, and defined by fins which are bayonet-coupled with specific circumferential slots 49 of the optical element 6, for example.

According to a further aspect of the invention, the reflecting/diffusing element 6 is formed so as to completely overhangingly protrude, in the direction of the optical axis X, from the first end 5 of the supporting body 4, with which it is formed in one piece and from a synthetic plastic material, so as it may be produced with a selectively variable opening angle, by simply replacing respective inserts 50 of a mould 51 (illustrated in dashed line, FIG. 1) for forming the body 4.

In case of applications requiring waterproofing, e.g. the application in the tank of a washing machine/dishwasher, at least the end 5 of the tubular body 4 is internally filled with an electrically insulating resin 60 which is poured into the seat 11 once the printed circuit 3 has been placed therein, so that a portion 61 thereof which is immediately close/adjacent to the end 13, is embedded in the resin 60, so as to seal the end 13 of the supporting body 4 in a substantially fluid-tight manner. In addition to this contrivance, the optical element 6 may be externally provided with a sealing ring 65 at the screen 45.

By virtue of its arrangement over the length of body 4, the printed circuit 3 preferably carries electronic means 70,71, in addition to the possible NTC 30 for controlling LED 2 (or 20) if this is an RGB LED. For example, these electronic means may be selected in the group consisting of: dusk sensor 70, evaporation freshener 71, self-powered battery, humidity sensor, temperature sensor, or combinations thereof.

Finally, given the overhanging arrangement of the end 13 of the printed circuit 3 within the concavity C, the optical element 6 may be provided with a supporting fin 80 carried by the reflecting portion 43. Further rail-shaped supporting fins 82, in which the sliding printed circuit 3 may be inserted, may be obtained in one piece with body 3, e.g. at the slots 26.

The invention claimed is:

1. A lamp for internal lighting of an electric household appliance, comprising:

at least one first light source including a light emitting diode (LED);

a printed circuit for supporting and powering the at least one first light source; and a supporting body for the printed circuit, the supporting body made of an electrically non-conductive material and provided, at a first end thereof, with a reflecting/diffusing element for light emitted from the at least one first light source, the reflecting/diffusing element defining an optical axis arranged substantially parallel to a longitudinal axis of the supporting body, wherein the at least one first light source is carried on a first flat face of the printed circuit and is mounted at a first end of the printed circuit, with a light diffusion axis of the at least one first light source oriented substantially perpendicular to the first flat face, the supporting body has a tubular shape and the printed circuit is supported inside the supporting body, with the first flat face arranged substantially coplanar with the optical axis of the reflecting/diffusing element and the first end of the printed circuit overhangingly protruding from the first end of the supporting body, within a concavity of the reflecting/diffusing element, so that the reflecting/diffusing element is arranged to collect at least a part of the light emitted from the at least one first light source, and the printed circuit extends over an entire length of the supporting body, to a second end of the supporting body opposite to the first end of the supporting body.

2. A lamp according to claim 1, wherein the printed circuit is provided, on at least the first flat face, with electrically and thermally conductive tracks connected to the at least one first light source, and the tracks are exposed in use to a convective cooling motion of the environmental air through respective longitudinal slots made through at least one side wall of the supporting body, at a predetermined distance from the first end of the supporting body and towards the second end of the supporting body.

3. A lamp according to claim 2, wherein the slots are made both above and below the optical axis and parallelly to the optical axis, so that some of the slots are facing the first flat face of the printed circuit and other slots are facing a second flat face of the printed circuit opposite to the first flat face.

4. A lamp according to claim 3, wherein the second flat face of the printed circuit is also provided with respective electrically and thermally conductive tracks and supports, at the first end of the printed circuit, at least one second light source including an LED, the at least one second light source also having a light diffusion axis perpendicular to the printed circuit and arranged within the concavity of the reflecting/diffusing element.

5. A lamp according to claim 1, wherein the LED is an RGB-type LED, and the printed circuit carries onboard electronic control circuitry for the LED.

6. A lamp according to claim 1, further comprising a cup-shaped optical element fitted over the first end of the supporting body so as to accommodate, at a concave bottom wall of the cup-shaped optical element, the reflecting/diffusing element, wherein at least one first portion of the concave bottom wall, facing the reflecting/diffusing element on a side of the at least one first light source is transparent to the light, and at least one second portion of the concave bottom wall, opposite to the at least one first portion with respect to the optical axis, is at least partially reflecting, so as to intercept at least a part of the light emitted from the at least one first light source to reflect the part of the light towards the reflecting/diffusing element.

7. A lamp according to claim 6, wherein the first and second portions of the concave bottom wall of the cup-shaped optical element are asymmetric, and the second portion of the concave bottom wall is a flat surface obliquely arranged with respect to the optical axis.

8. A lamp according to claim 6, wherein the reflecting/diffusing element is shaped so as to collect the part of the light reflected by the second portion of the concave bottom wall of the cup-shaped optical element and at least one part of the light directly emitted from the at least one first light source for directing both parts of of the light towards the first portion of the concave bottom wall, so as to form a predominant lighting beam having an oblique axis and placed at a solid angle delimited by the optical axis and by the light diffusion axis of the at least one first light source.

9. A lamp according to claim 6, wherein the reflecting/diffusing element is at least partially transparent to the light, and the supporting body is provided, on a part of the second end of the supporting body, with a reflecting screen and with a corresponding connecting element for the cup-shaped optical element arranged at the reflecting screen, immediately adjacent to the reflecting screen on a side of the second end of the supporting body.

10. A lamp according to claim 1, wherein the reflecting/diffusing element is formed so as to completely overhangingly protrude, in a direction of the optical axis, from the first end of the supporting body, with which the reflecting/diffusing element is integrally formed in a synthetic plastic material, so that the reflecting/diffusing element makes a selectively variable opening angle, simply by replacing respective inserts of a mould for forming the supporting body.

11. A lamp according to claim 1, wherein a first end of the tubular body is internally filled with an electrically insulating resin in which a portion of the printed circuit close to the first end of the tubular body is embedded, so as to seal the first end of the supporting body in a substantially fluid-tight manner.

12. A lamp according to claim 1, wherein the printed circuit carries an electronic component selected from the group consisting of a dusk sensor, an evaporation freshener, a self-powered battery, a humidity sensor, a temperature sensor and combinations thereof.

* * * * *